US010510314B2

(12) United States Patent
Lv et al.

(10) Patent No.: US 10,510,314 B2
(45) Date of Patent: Dec. 17, 2019

(54) GOA CIRCUIT HAVING NEGATIVE GATE-SOURCE VOLTAGE DIFFERENCE OF TFT OF PULL DOWN MODULE

(71) Applicant: Shenzhen China Star Optoelectronics Semiconductor Display Technology Co., Ltd., Shenzhen (CN)

(72) Inventors: Xiaowen Lv, Shenzhen (CN); Yifang Chou, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 126 days.

(21) Appl. No.: 15/742,041

(22) PCT Filed: Nov. 29, 2017

(86) PCT No.: PCT/CN2017/113475
§ 371 (c)(1),
(2) Date: Jan. 5, 2018

(87) PCT Pub. No.: WO2019/071758
PCT Pub. Date: Apr. 18, 2019

(65) Prior Publication Data

US 2019/0108808 A1 Apr. 11, 2019

(30) Foreign Application Priority Data

Oct. 11, 2017 (CN) ..... 2017 1 0943843

(51) Int. Cl.
*G09G 3/36* (2006.01)

(52) U.S. Cl.
CPC ..... *G09G 3/3677* (2013.01); *G09G 2310/06* (2013.01); *G09G 2310/08* (2013.01); *G09G 2320/0214* (2013.01)

(58) Field of Classification Search
CPC ..... G09G 3/3677; G09G 2300/0408; G09G 2300/0842
See application file for complete search history.

(56) References Cited

U.S. PATENT DOCUMENTS 8,860,651 B2 * 10/2014 Tseng ..... G11C 19/28 345/100
9,024,858 B2 * 5/2015 Koo ..... G11C 19/28 345/100

(Continued)

FOREIGN PATENT DOCUMENTS

CN 106448590 A 2/2017

*Primary Examiner* — Chad M Dicke
(74) *Attorney, Agent, or Firm* — Leong C. Lei

(57) ABSTRACT

The invention provides a GOA circuit, comprising a plurality of cascaded GOA units. Each GOA unit comprises: a pull up control module, an output module, a pull down module and a pull down maintenance module; for N-th GOA unit: the 41$^{st}$ TFT of pull down module having a gate receiving a scan signal from (N+4)-th GOA unit, a source connected to a circuit start signal, and a drain connected to the first node, and the circuit start signal having a low voltage level lower than or equal to 0V and higher than the low voltage signal; so that when the scan signal from (N+4)-th GOA unit changing from high voltage to low voltage, the gate-source voltage difference of the 41$^{st}$ TFT being negative to effectively reduce the current leakage and prevent the current leakage from affecting the first node voltage, improve circuit stability, facilitate cost reduction and narrow border.

15 Claims, 5 Drawing Sheets

(56) References Cited

U.S. PATENT DOCUMENTS

| | | | | |
|---|---|---|---|---|
| 9,472,150 | B1 * | 10/2016 | Dai | G09G 3/3648 |
| 9,472,155 | B2 * | 10/2016 | Xiao | G09G 3/3677 |
| 9,524,689 | B2 * | 12/2016 | Dai | G11C 19/184 |
| 9,530,367 | B2 * | 12/2016 | Xiao | G09G 3/3648 |
| 9,865,196 | B2 * | 1/2018 | Lin | G09G 3/3233 |
| 9,922,997 | B2 * | 3/2018 | Xiao | H01L 27/124 |
| 10,019,929 | B2 * | 7/2018 | Shim | G09G 3/3677 |
| 10,032,416 | B2 * | 7/2018 | Zhang | G09G 3/3233 |
| 2010/0309191 | A1 * | 12/2010 | Hsu | G09G 3/3677 345/213 |
| 2015/0171833 | A1 * | 6/2015 | Pi | H03K 3/012 327/109 |
| 2016/0064098 | A1 * | 3/2016 | Han | G11C 19/28 345/211 |
| 2016/0086562 | A1 * | 3/2016 | Tan | G09G 3/3677 345/215 |
| 2017/0213497 | A1 * | 7/2017 | Shang | G09G 3/20 |
| 2018/0218686 | A1 * | 8/2018 | Li | G11C 19/28 |
| 2018/0218701 | A1 * | 8/2018 | Yi | G09G 3/3677 |
| 2018/0261177 | A1 * | 9/2018 | Han | G09G 3/3677 |

* cited by examiner

GOA CIRCUIT HAVING NEGATIVE GATE-SOURCE VOLTAGE DIFFERENCE OF TFT OF PULL DOWN MODULE

BACKGROUND OF THE INVENTION

1. Field of the Invention

The present invention relates to the field of display techniques, and in particular to a gate driver on array (GOA) circuit.

2. The Related Arts

The liquid crystal display (LCD) provides many advantages, such as thinness, low power-consumption and no radiation, and is widely used in, such as, LCD televisions, mobile phones, personal digital assistants (PDAs), digital cameras, computer screens, laptop screens, and so on. The LCD technology also dominates the field of panel displays.

Most of the LCDs on the current market are of backlight type, which comprises an LCD panel and a backlight module. The operation theory behind LCD is to inject the liquid crystal (LC) molecules between a thin film transistor (TFT) array substrate and a color filter (CF) substrate, and applies a driving voltage between the two substrates to control the rotation direction of the LC molecules to refract the light from the backlight module to generate the image on the display.

In the active LCD, each pixel is electrically connected to a TFT, with a gate (Gate) connected to a horizontal scan line, a source (Source) connected to a data line in a vertical direction, and a drain (Drain) connected to a pixel electrode. When a sufficient positive voltage is applied to a horizontal scan line, all the TFTs connected to the scan line are turned on, the signal voltage loaded on the data line is written into the pixel to control the transmittance of different liquid crystals to achieve the effect of color control. The driving of the horizontal scan line of the current active LCD is mainly executed by an external integrated circuit (IC). The external IC can control the charge and discharge of the horizontal scan line in each stage progressively.

The gate driver on array (GOA) technology, i.e., the array substrate row driving technology, can use the array process of the LCD panel to manufacture the driver circuit of the horizontal scan lines on the substrate at area surrounding the active area to replace the external IC for driving the horizontal scan lines. The GOA technology can reduce the bonding process for external IC and has the opportunity to enhance yield rate and reduce production cost, as well as make the LCD panel more suitable for the production of narrow border display products.

FIG. 1 shows a schematic view of a known GOA circuit. The GOA circuit comprises a plurality of cascaded GOA units, with each of the GOA units comprising a pull-up control module 100', an output module 200', a pull-down module 300', and a pull-down maintenance module 400'. For a positive integer N, except the first to the fourth GOA units and the last fourth to first GOA units, in the N-th GOA unit: the pull-up control module 100' comprises an eleventh TFT T11', the eleventh TFT T11' has a gate connected to cascade-propagate signal ST(N−4)' of the fourth previous GOA unit (i.e. the (N−4)-th GOA unit), the source connected to the high voltage signal VDD, and the drain connected to the first node Q(N)'. The output module 200' comprises a twenty-first TFT T21', a twenty-second TFT T22' and a first capacitor C1'; the twenty-first TFT T21' has a gate the first node Q(N)', a source connected to a clock signal CK', and a drain outputting a scan signal G(N)'; the twenty-second TFT T22' has a gate connected to the first node Q(N)', a source clock signal CK', and a drain outputting a cascade-propagate signal ST(N)'; the first capacitor C1' has one end connected to the first node Q(N)' and the other end connected to the drain of the twenty-first TFT T21'. The pull-down module 300's comprises a forty-first TFT T41', the forty-first TFT 41' has a gate connected to the fourth next GOA unit (i.e., (N+4)-th GOA unit), a source connected to the low voltage signal VSS, and a drain connected to the first node Q(N)'. The pull-down maintenance module 400' comprises a thirty-second TFT T32', a forty-second TFT T42', a fifty-first TFT T51' and a fifty-second TFT T52'; the thirty-second TFT T32' has a gate connected to a second node P(N)', a source connected to the low voltage signal VSS, and a drain connected to the other end of the first capacitor C1'; the forty-second TFT T42' has a gate connected to the second node P(N)', a source connected to the low voltage signal VSS, and a drain connected to the first node Q(N)'; the fifty-one TFT T51' has a gate and a source connected to a control signal LC', and a drain connected to the second node P (N)'; the fifty-second TFT T52' has a gate of the first node Q(N)', a source connected to the low voltage signal VSS, and a drain connected to the second node P(N)'. The GOA circuit operates as follows: when the cascade-propagate signal ST(N−4)' of the (N−4)-th GOA unit is at high voltage, the eleventh TFT T11' is turned on to write the high voltage signal VDD to the first node Q(N)' to control the twenty-first TFT T21' and the twenty-second TFT T22' to output respectively a scan signal G(N)' corresponding to the clock signal CK' and the cascade-propagate signal ST(N); then when the scan signal G(N+4)' of the (N+4)-th GOA unit is at high level, the forty-first TFT T41' is turned on to pull down the first node Q(N)' to the level of low voltage signal VSS so that the fifty-second TFT T52' is cut off; the control signal LC' turns on the thirty-second TFT T32' and the forty-second TFT T42' to maintain the scan signal G(N) and the first node Q(N)' at the level of low voltage signal VSS. However, when the scan signal G(N+4)' of the (N+4)-th GOA unit is changed from the high voltage to the low voltage, the low voltage is consistent with the level of low voltage signal VSS; that is, at this time, the gate-source voltage difference Vgs of the forty-first TFT T41' is zero. However, in the conventional case that a GOA circuit is formed by using an amorphous (a-Si) silicon TFT, a gate-source voltage difference of 0 is not a point with the TFT smallest current leakage, which causes a leakage in the forty-first TFT T41' and affects the voltage level of the first node Q(n)'. In order to improve the performance of the GOA circuit, the current method is to use two low voltage signals with different voltage levels to make the gate of the TFT have a negative gate voltage to make the leakage current of the TFT smaller. However, this method requires additional signal lines, resulting in increased space for fanout layout, which is not disadvantageous to narrow border, increases the number of signals and increases the production cost.

SUMMARY OF THE INVENTION

The object of the present invention is to provide a GOA circuit, able to reduce the current leakage of the TFT in the pull down module to prevent the current leakage from affecting the voltage level of the first node, and to improve the circuit stability without additional signal lines, able to facilitate production cost reduction and achieving narrow border design.

To achieve the above object, the present invention provides a GOA circuit, which comprises a plurality of cascaded GOA units, with each GOA unit comprising: a pull up control module, an output module, a pull down module and a pull down maintenance module;

for an positive integer N, except the first to the fourth GOA units and the last fourth to the last GOA units, in the N-th GOA unit:

the pull up control module receiving a cascade-propagate signal from (N−4)-th GOA unit and a high voltage signal, connected to a first node, for pulling up voltage at the first node to the high voltage signal based on the cascade-propagate signal from (N−4)-th GOA unit; the output module receiving clock signal and connected to the first node, for outputting a scan signal and a cascade-propagate signal under control by the voltage of the first node; the pull down module comprising a $41^{st}$ TFT, the $41^{st}$ TFT having a gate connected to receive a scan signal from (N+4)-th GOA unit, a source connected to a circuit start signal, and a drain connected to the first node; the pull down maintenance module receiving the scan signal and a low voltage signal, connected to the first node, for maintaining the scan signal and the voltage of the first node at the low voltage signal after the pull down module pulling down the voltage of the first node;

the circuit start signal being a pulse signal, and the circuit start signal having a low voltage level lower than or equal to 0V and higher than the low voltage signal.

According to a preferred embodiment of the present invention, the clock signal comprises: a first clock signal, a second clock signal, a third clock signal, a fourth clock signal, a fifth clock signal, a sixth clock signal, a seventh clock signal, and an eight clock signal, outputted serially; for a non-negative integer X, the (1+8X)-th GOA unit, the (2+8X)-th GOA unit, the (3+8X)-th GOA unit, the (4+8X)-th GOA unit, the (5+8X)-th GOA unit, the (6+8X)-th GOA unit, the (7+8X)-th GOA unit, and the (8+8X)-th GOA unit respectively receive the first clock signal, the second clock signal, the third clock signal, the fourth clock signal, the fifth clock signal, the sixth clock signal, the seventh clock signal, and the eight clock signal;

two adjacent clock signals have rising edges with a gap of ⅛ of cycle of the clock signal, the clock signal has a duty cycle ratio of 0.4;

the circuit start signal has a high voltage duration equal to ¾ of the cycle of the clocks signal;

the circuit start signal has a rising edge earlier than the rising edge of the first clock signal, with a gap of ¼ of the cycle of the clocks signal.

According to a preferred embodiment of the present invention, the low voltage level of circuit start signal and the low voltage signal have a voltage difference of 1.5-2.5V.

According to a preferred embodiment of the present invention, the low voltage level of circuit start signal is −4V and the low voltage signal is −6V.

According to a preferred embodiment of the present invention, except the first to the fourth GOA units, in the N-th GOA unit: the pull up control module comprises: a $11^{th}$ TFT; the $11^{th}$ TFT having a gate connected to the cascade-propagate signal from the (N−4)-th GOA unit, a source connected to the high voltage signal, and a drain connected to the first node.

According to a preferred embodiment of the present invention, the output module comprises: a $21^{st}$ TFT, a $22^{nd}$ TFT, and a capacitor; the $21^{st}$ TFT having a gate connected to the first node, a source connected to the clock signal, and a drain outputting the scan signal; the $22^{nd}$ TFT having a gate connected to the first node, a source connected to the clock signal, and a drain outputting the cascade-propagate signal; the capacitor having one end connected to the first node and the other end connected to the drain of the $21^{st}$ TFT.

According to a preferred embodiment of the present invention, the pull down maintenance module comprises: a $32^{nd}$ TFT, a $42^{nd}$ TFT, a $51^{st}$ TFT, and a $52^{nd}$ TFT; the $32^{nd}$ TFT having a gate connected to a second node, a source connected to the low voltage signal, and a drain connected to the drain of the $21^{st}$ TFT; the $42^{nd}$ TFT having a gate connected to the second node, a source connected to the low voltage signal, and a drain connected to the first node; the $51^{st}$ TFT having a gate and a source connected to a control signal, and a drain connected to the second node; $52^{nd}$ TFT having a gate connected to the first node, a source connected to the low voltage signal, and a drain connected to the second node.

According to a preferred embodiment of the present invention, the control signal maintains at high voltage during the GOA unit operates.

According to a preferred embodiment of the present invention, in the first to the fourth GOA units, the pull up control module comprises: an $11^{th}$ TFT, the $11^{th}$ TFT having a gate connected to the circuit start signal, a source connected to the high voltage signal, and a drain connected to the first node.

According to a preferred embodiment of the present invention, in the last fourth to the last GOA units, the pull down module comprises: a $41^{st}$ TFT, the $41^{st}$ TFT having a gate connected to the circuit start signal, a source connected to the low voltage signal, and a drain connected to the first node.

The present invention also provides a GOA circuit, which comprises a plurality of cascaded GOA units, with each GOA unit comprising: a pull up control module, an output module, a pull down module and a pull down maintenance module;

for an positive integer N, except the first to the fourth GOA units and the last fourth to the last GOA units, in the N-th GOA unit:

the pull up control module receiving a cascade-propagate signal from (N−4)-th GOA unit and a high voltage signal, connected to a first node, for pulling up voltage at the first node to the high voltage signal based on the cascade-propagate signal from (N−4)-th GOA unit; the output module receiving clock signal and connected to the first node, for outputting a scan signal and a cascade-propagate signal under control by the voltage of the first node; the pull down module comprising a $41^{st}$ TFT, the $41^{st}$ TFT having a gate connected to receive a scan signal from (N+4)-th GOA unit, a source connected to a circuit start signal, and a drain connected to the first node; the pull down maintenance module receiving the scan signal and a low voltage signal, connected to the first node, for maintaining the scan signal and the voltage of the first node at the low voltage signal after the pull down module pulling down the voltage of the first node;

the circuit start signal being a pulse signal, and the circuit start signal having a low voltage level lower than or equal to 0V and higher than the low voltage signal;

wherein the clock signal comprising: a first clock signal, a second clock signal, a third clock signal, a fourth clock signal, a fifth clock signal, a sixth clock signal, a seventh clock signal, and an eight clock signal, outputted serially; for a non-negative integer X, the (1+8X)-th GOA unit, the (2+8X)-th GOA unit, the (3+8X)-th GOA unit, the (4+8X)- th GOA unit, the (5+8X)-th GOA unit, the (6+8X)-th GOA unit, the (7+8X)-th GOA unit, and the (8+8X)-th GOA unit respectively receiving the first clock signal, the second clock signal, the third clock signal, the fourth clock signal, the fifth clock signal, the sixth clock signal, the seventh clock signal, and the eight clock signal;

two adjacent clock signals having rising edges with a gap of ⅛ of cycle of the clock signal, the clock signal having a duty cycle ratio of 0.4;

the circuit start signal having a high voltage duration equal to ¾ of the cycle of the clocks signal;

the circuit start signal having a rising edge earlier than the rising edge of the first clock signal, with a gap of ¼ of the cycle of the clocks signal;

Wherein, except the first to the fourth GOA units, in the N-th GOA unit: the pull up control module comprising: a $11^{th}$ TFT; the $11^{th}$ TFT having a gate connected to the cascade-propagate signal from the (N−4)-th GOA unit, a source connected to the high voltage signal, and a drain connected to the first node;

wherein the output module comprising: a $21^{st}$ TFT, a $22^{nd}$ TFT, and a capacitor; the $21^{st}$ TFT having a gate connected to the first node, a source connected to the clock signal, and a drain outputting the scan signal; the $22^{nd}$ TFT having a gate connected to the first node, a source connected to the clock signal, and a drain outputting the cascade-propagate signal; the capacitor having one end connected to the first node and the other end connected to the drain of the $21^{st}$ TFT;

wherein the pull down maintenance module comprising: a $32^{nd}$ TFT, a $42^{nd}$ TFT, a $51^{st}$ TFT, and a $52^{nd}$ TFT; the $32^{nd}$ TFT having a gate connected to a second node, a source connected to the low voltage signal, and a drain connected to the drain of the $21^{st}$ TFT; the $42^{nd}$ TFT having a gate connected to the second node, a source connected to the low voltage signal, and a drain connected to the first node; the $51^{st}$ TFT having a gate and a source connected to a control signal, and a drain connected to the second node; $52^{nd}$ TFT having a gate connected to the first node, a source connected to the low voltage signal, and a drain connected to the second node;

wherein the control signal maintaining at high voltage during the GOA unit operates.

The present invention provides the following advantages. The present invention provides a GOA circuit, comprising a plurality of cascaded GOA units, with each GOA unit comprising: a pull up control module, an output module, a pull down module and a pull down maintenance module; for N-th GOA unit: the $41^{st}$ TFT of the pull down module having a gate receiving a scan signal from the (N+4)-th GOA unit, a source connected to a circuit start signal, and a drain connected to the first node, and the circuit start signal having a low voltage level lower than or equal to 0V and higher than the low voltage signal; so that when the scan signal from the (N+4)-th GOA unit changing from high voltage to low voltage, the gate-source voltage difference of the $41^{st}$ TFT being negative to effectively reduce the current leakage and prevent the current leakage from affecting the voltage of the first node, to improve the circuit stability without additional signal lines, able to facilitate production cost reduction and achieving narrow border design.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technique means and effect of the present invention, the following uses preferred embodiments and drawings for detailed description.

Figure 1:
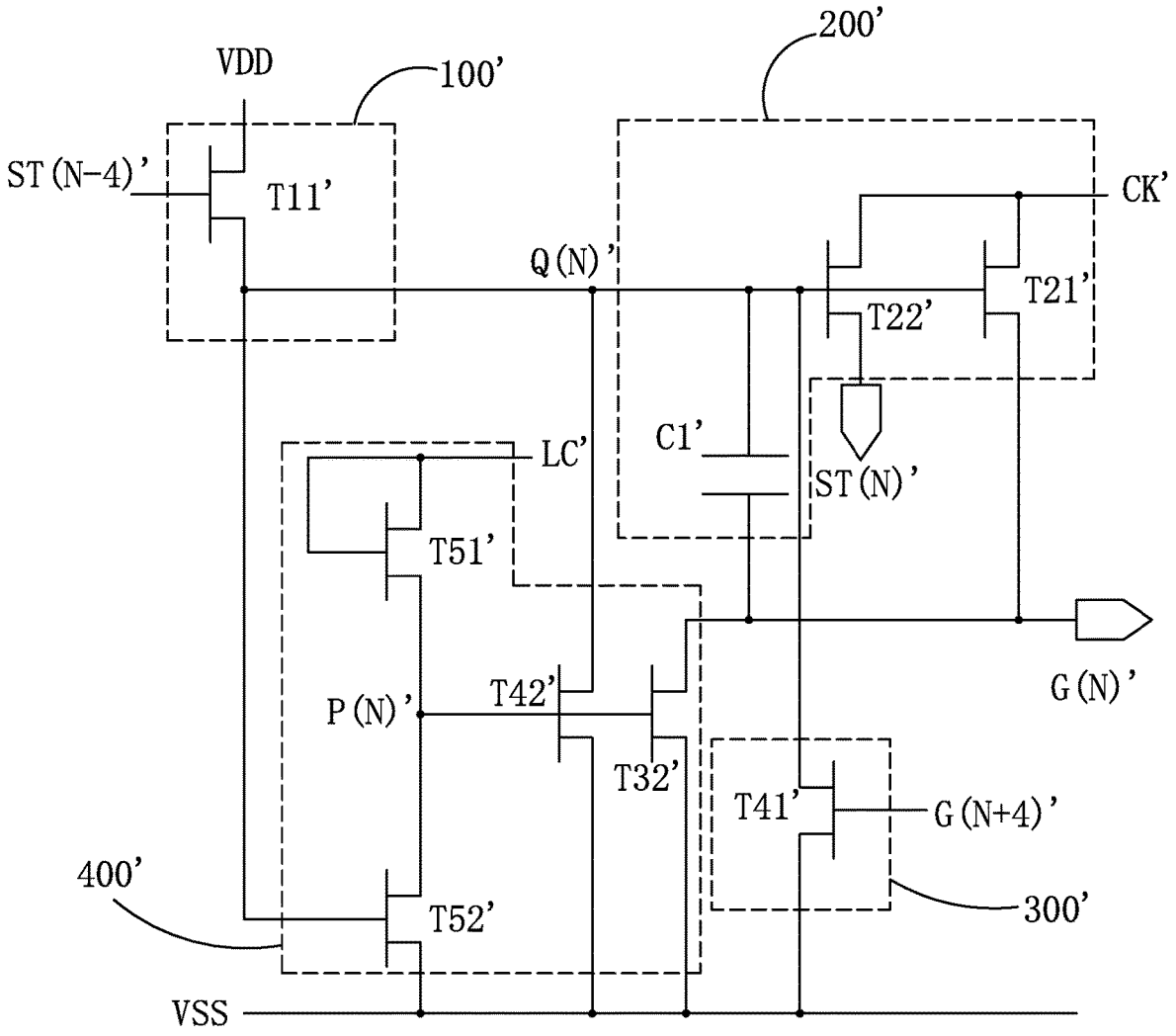
FIG. 1 is a schematic view showing a known GOA circuit.
Figure 2:
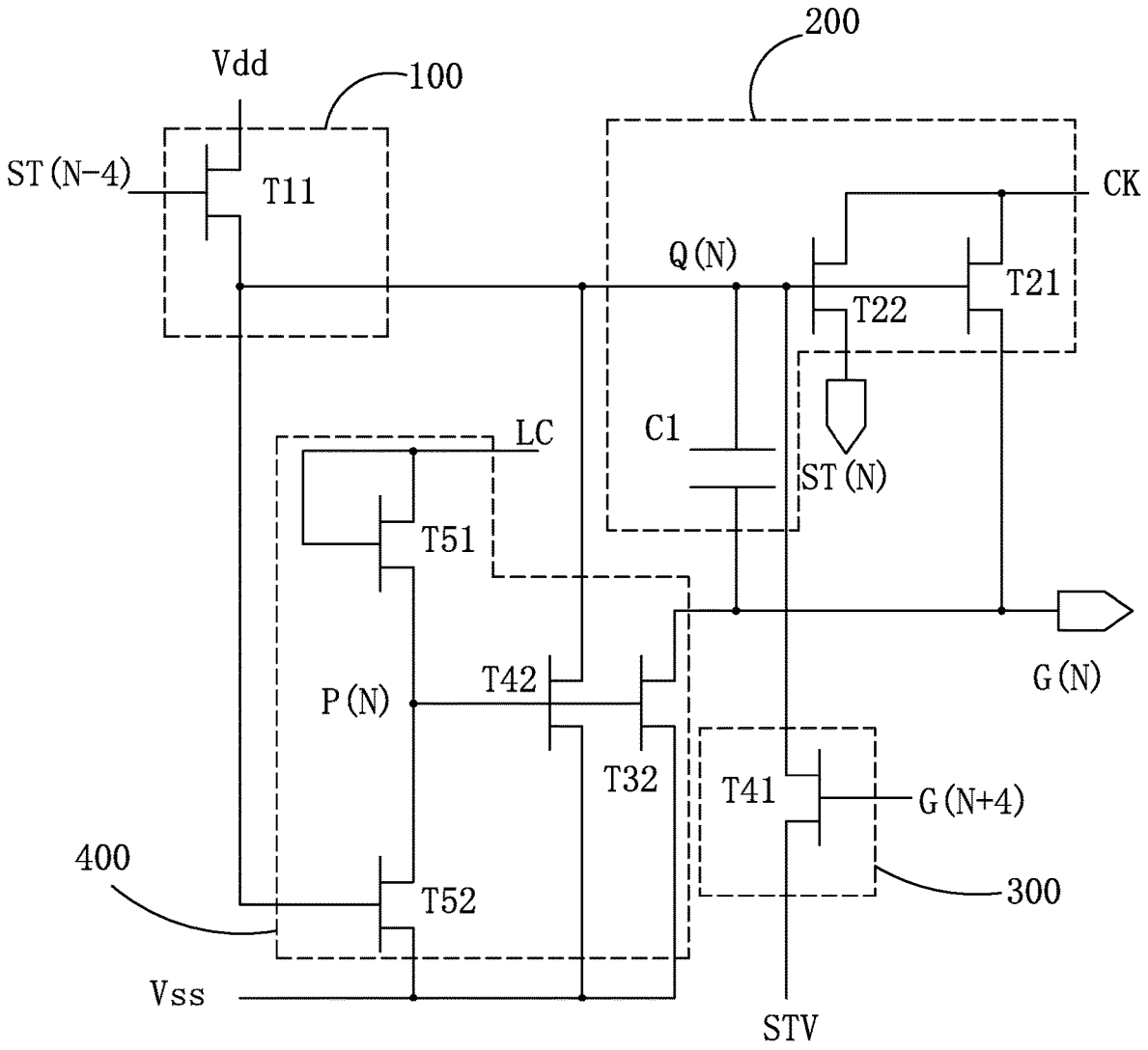
FIG. 2 is a schematic view showing a circuit of the GOA circuit provided by the first embodiment of the present invention.

Referring to FIG. 2, the present invention provides a GOA circuit, which comprises: a plurality of cascaded GOA units, with each GOA unit comprising: a pull up control module 100, an output module 200, a pull down module 300 and a pull down maintenance module 400;

for an positive integer N, except the first to the fourth GOA units and the last fourth to the last GOA units, in the N-th GOA unit:

the pull up control module 100 receiving a cascade-propagate signal ST(N−4) from (N−4)-th GOA unit and a high voltage signal VDD, connected to a first node Q(N), for pulling up voltage at the first node Q(N) to the high voltage signal VDD based on the cascade-propagate signal ST(N−4) from (N−4)-th GOA unit.

Specifically, the pull up control module 100 comprises: a $11^{th}$ TFT T11; the $11^{th}$ TFT T11 having a gate connected to the cascade-propagate signal ST(N−4) from the (N−4)-th GOA unit, a source connected to the high voltage signal VDD, and a drain connected to the first node Q(N).

The output module 200 receives clock signal CK and connected to the first node Q(N), for outputting a scan signal G(N) and a cascade-propagate signal ST(N) under control by the voltage of the first node Q(N).

Specifically, the output module 200 comprises: a $21^{st}$ TFT T21, a $22^{nd}$ TFT T22, and a capacitor C1; the $21^{st}$ TFT T21 having a gate connected to the first node Q(N), a source connected to the clock signal CK, and a drain outputting the scan signal G(N); the $22^{nd}$ TFT T22 having a gate connected to the first node Q(N), a source connected to the clock signal CK, and a drain outputting the cascade-propagate signal ST(N); the capacitor having one end connected to the first node Q(N) and the other end connected to the drain of the $21^{st}$ TFT T21.

The pull down module 300 comprises: a $41^{st}$ TFT T41, the $41^{st}$ TFT T41 having a gate connected to receive a scan signal G(N+4) from (N+4)-th GOA unit, a source connected to a circuit start signal STV, and a drain connected to the first node Q(N); the circuit start signal is a pulse signal, and the circuit start signal has a low voltage level lower than or equal to 0V and higher than a low voltage signal Vss; also, the pull down module 300 is for pulling down the voltage at the first node Q(N) to the low voltage level of the circuit start signal STV according to the scan signal G(N+4) of the (N+4)-th GOA unit.

Specifically, the low voltage level of circuit start signal STV and the low voltage signal Vss have a voltage difference of 1.5-2.5V.

Specifically, the low voltage level of circuit start signal STV is −4V and the low voltage signal Vss is −6V.

The pull down maintenance module 400 receives the scan signal G(N) and the low voltage signal Vss, connected to the first node Q(N), for maintaining the scan signal G(N) and the voltage of the first node Q(N) at the low voltage signal Vss after the pull down module 300 pulling down the voltage of the first node Q(N).

Specifically, the pull down maintenance module 400 comprises: a $32^{nd}$ TFT t32, a $42^{nd}$ TFT T42, a $51^{st}$ TFT T51, and a $52^{nd}$ TFT T52; the $32^{nd}$ TFT T32 having a gate connected to a second node P(N), a source connected to the low voltage signal Vss, and a drain connected to the drain of the $21^{st}$ TFT T21; the $42^{nd}$ TFT T42 having a gate connected to the second node P(N), a source connected to the low voltage signal Vss, and a drain connected to the first node Q(N); the $51^{st}$ TFT T51 having a gate and a source connected to a control signal LC, and a drain connected to the second node P(N); $52^{nd}$ TFT T52 having a gate connected to the first node Q(N), a source connected to the low voltage signal Vss, and a drain connected to the second node P(N).

Moreover, the control signal maintains at high voltage during the GOA unit operates.

Figure 5:
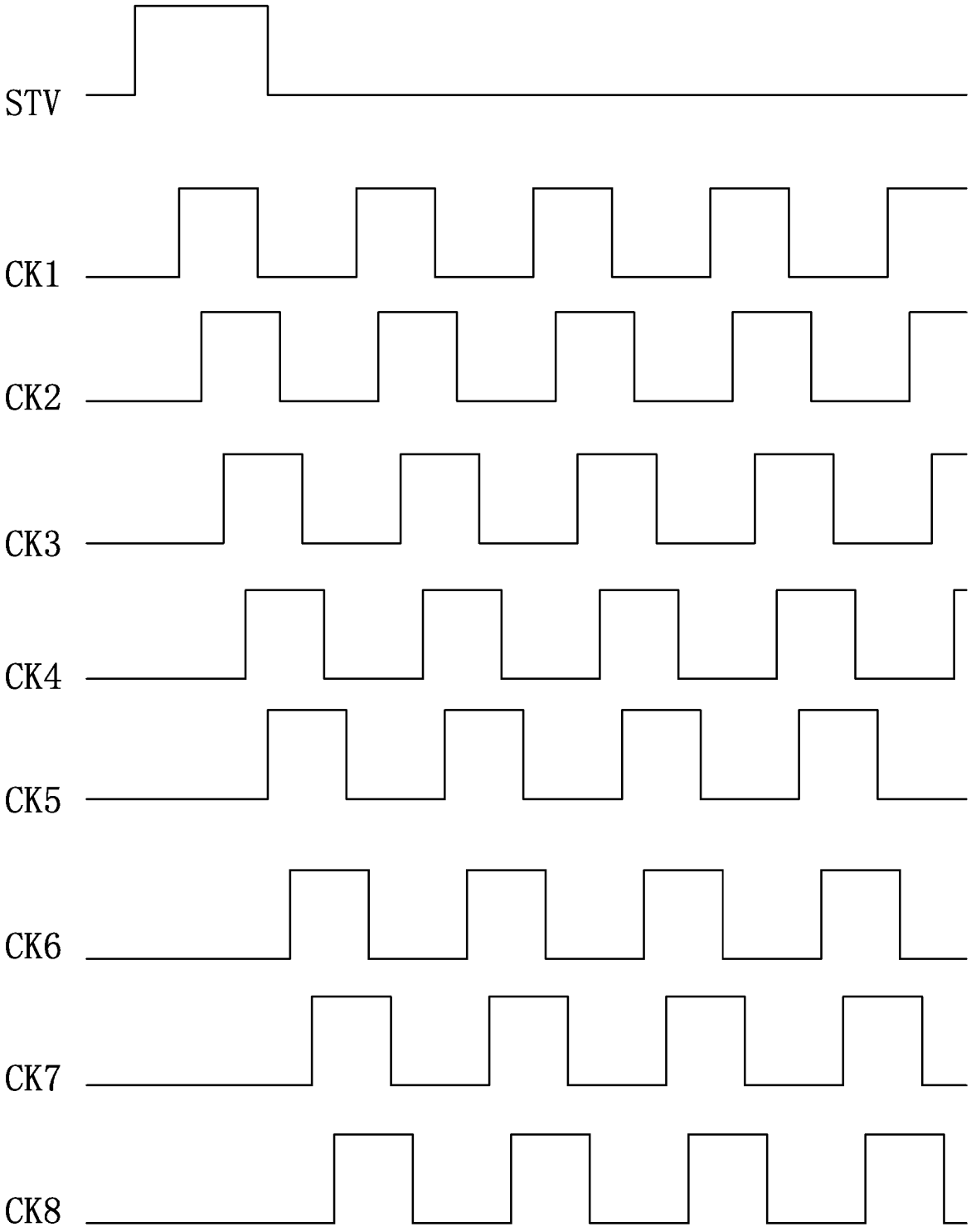
FIG. 5 is a schematic view showing the timing sequence for the GOA circuit by the embodiment of the present invention.

Specifically, refer to FIG. 5. The clock signal CK comprises: a first clock signal CK1, a second clock signal CK2, a third clock signal CK3, a fourth clock signal CK4, a fifth clock signal CK5, a sixth clock signal CK6, a seventh clock signal CK7, and an eight clock signal CK8, outputted serially; for a non-negative integer X, the (1+8X)-th GOA unit, the (2+8X)-th GOA unit, the (3+8X)-th GOA unit, the (4+8X)-th GOA unit, the (5+8X)-th GOA unit, the (6+8X)-th GOA unit, the (7+8X)-th GOA unit, and the (8+8X)-th GOA unit respectively receive the first clock signal CK1, the second clock signal CK2, the third clock signal CK3, the fourth clock signal CK4, the fifth clock signal CK5, the sixth clock signal CK6, the seventh clock signal CK7, and the eight clock signal CK8; two adjacent clock signals CK have rising edges with a gap of ⅛ of cycle of the clock signal CK, the clock signal CK has a duty cycle ratio of 0.4; the circuit start signal STV has a high voltage duration equal to ¾ of the cycle of the clocks signal CK; the circuit start signal STV has a rising edge earlier than the rising edge of the first clock signal CK1, with a gap of ¼ of the cycle of the clocks signal CK.

Figure 3:
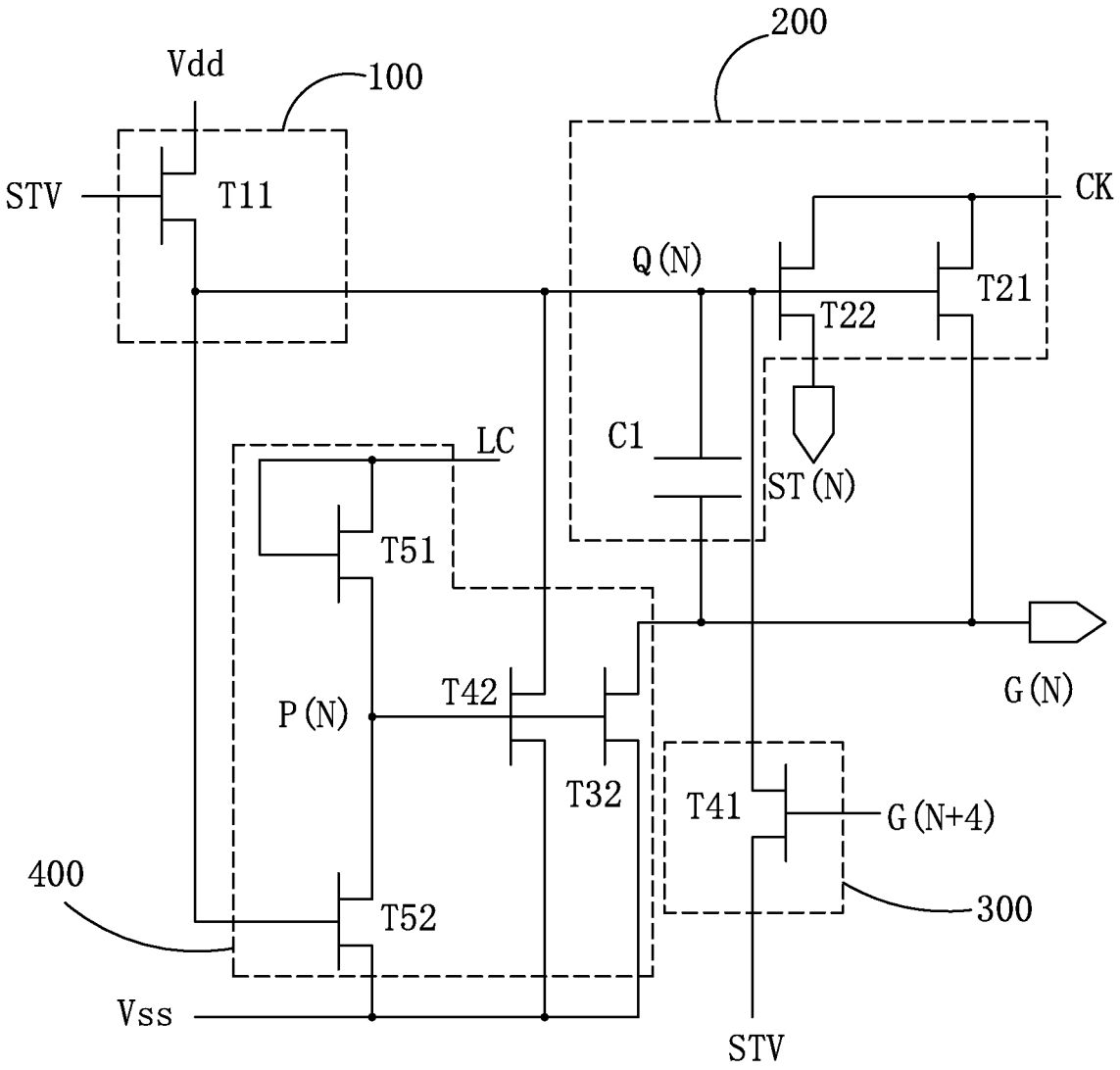
FIG. 3 is a schematic view showing a circuit of the first to the fourth GOA units of the GOA circuit provided by the first embodiment of the present invention.
Figure 4:
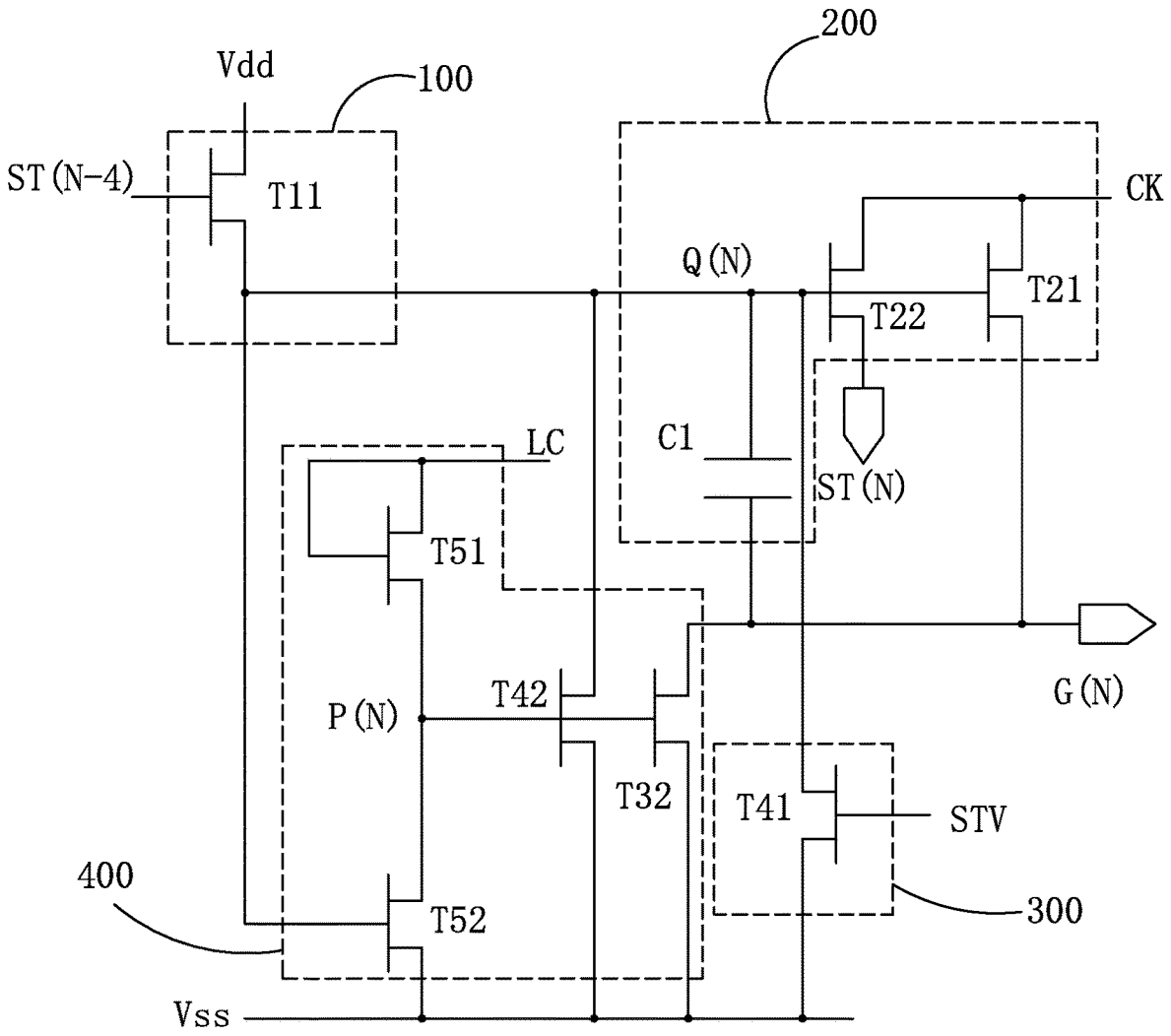
FIG. 4 is a schematic view showing a circuit of the last fourth to the last GOA units of the GOA circuit provided by the first embodiment of the present invention.

Specifically, refer to FIG. 3. In the first to the fourth GOA units, the pull up control module 100 comprises: an $11^{th}$ TFT T11, the $11^{th}$ TFT T11 having a gate connected to the circuit start signal STV, a source connected to the high voltage signal VDD, and a drain connected to the first node Q(N). Refer to FIG. 4. In the last fourth to the last GOA units, the pull down module 300 comprises: a $41^{st}$ TFT T41, the $41^{st}$ TFT T41 having a gate connected to the circuit start signal STV, a source connected to the low voltage signal VSS, and a drain connected to the first node Q(N).

Refer to FIG. 2 to FIG. 5. The GOA circuit of the present invention operates as follows: the circuit start signal STV first provides a high voltage, the $11^{th}$ TFT T11 in the first to the fourth GOA units are turned on, and the voltage at the first node Q(N) in the first to the fourth GOA units rises to the high voltage, the $21^{st}$ TFT T21 and the $22^{nd}$ TFT T22 in the first to the fourth GOA units are both turned on, and then the first clock signal CK1 outputs a high voltage. The first GOA unit outputs the scan signal and the cascade-propagate signal; then, the second clock signal CK2 outputs the high voltage, and the second GOA unit outputs the scan signal and the cascade-propagate signal; then, the third clock signal CK3 outputs the high voltage, and the third GOA unit outputs the scan signal and the cascade-propagate signal; and then, the fourth clock signal CK4 outputs the high voltage, and the fourth GOA unit outputs the scan signal and the cascade-propagate signal. The cascade-propagate signals from the first GOA unit, the second GOA unit, the third GOA unit, and the fourth GOA unit are passed respectively to the pull-up control module 100 of the fifth GOA unit, the sixth GOA unit, the seventh GOA unit, the eighth GOA unit. After receiving the corresponding cascade-propagate signal, the $11^{th}$ TFT T11 of the fifth GOA unit, the sixth GOA unit, the seventh GOA unit, and the eighth GOA unit is turned on serially, and the fifth clock signal CK5, the sixth clock signal CK6, the seventh clock signal CK7, and the eighth clock signal CK8 serially start to provide a high voltage, and the fifth GOA unit, the sixth GOA unit, the seventh GOA unit, and the eighth GOA unit respectively output the scan signal and the cascade-propagate signal during the time when the fifth clock signal CK5, the sixth clock signal CK6, the seventh clock signal CK7, and the eighth clock signal CK8 are at high voltage. The pull-down module 300 of the first GOA unit, the second GOA unit, the third GOA unit, and the fourth GOA unit respectively receives the scan signal from the fifth GOA unit, the sixth GOA unit, the seventh GOA unit, and the eighth GOA unit, and correspondingly pull down the first GOA unit, the second GOA unit, the third GOA unit, and the fourth GOA Unit to the voltage level of the low voltage signal Vss, and then the pull down maintenance module 400 maintains the first node and the scan signal at the voltage level of the low voltage signal Vss, and so on, until the last fourth GOA unit, the last third GOA unit, the lasts second GOA unit, and the last GOA unit serially output the scan signal and the cascade-propagate signal, and the circuit start signal STV again provides a high voltage to the pull down module 300 of the last fourth GOA unit, the last third GOA unit, the last second GOA unit, and the last GOA unit to pull down the first node of the last fourth GOA unit, the last third GOA unit, the last second GOA unit, and the last GOA unit to the voltage level of low voltage signal Vss and the pull down maintenance module 400 of the last fourth GOA unit, the last third GOA unit, the last second GOA unit, and the last GOA unit maintains the first node and the scan signal at the voltage level of the low voltage signal Vss.

It should be noted that except the last fourth to the last GOA units, in the N-th GOA unit, when the scan signal G(N+4) of the (N+4)-th GOA unit is maintained by the pull down maintenance module 400 of the (N+4)-th GOA unit at the voltage level of the low voltage signal Vss, the gate of the $41^{st}$ TFT T41 of the pull down module 300 of the N-th GOA unit has the voltage level of the low voltage signal Vss, and at this point, the source of the $41^{st}$ TFT T41 is at the low voltage level of the circuit start signal STV. Because the low voltage level of the circuit start signal STV is higher than the voltage level of the low voltage signal Vss, the gate-source voltage difference Vgs of the $41^{st}$ TFT T41 is negative, which can effectively reduce the leakage current of the $41^{st}$ TFT T41, prevent the leakage current from affecting the voltage of the first node Q(N), improve the circuit stability without additional signal lines, and can reduce product costs and achieve narrow border design.

In summary, the present invention provides a GOA circuit, comprising a plurality of cascaded GOA units, with each GOA unit comprising: a pull up control module, an output module, a pull down module and a pull down maintenance module; for N-th GOA unit: the $41^{st}$ TFT of the pull down module having a gate receiving a scan signal from the (N+4)-th GOA unit, a source connected to a circuit start signal, and a drain connected to the first node, and the circuit start signal having a low voltage level lower than or equal to 0V and higher than the low voltage signal; so that when the scan signal from the (N+4)-th GOA unit changing from high voltage to low voltage, the gate-source voltage difference of the $41^{st}$ TFT being negative to effectively reduce the current leakage and prevent the current leakage from affecting the voltage of the first node, to improve the circuit stability without additional signal lines, able to facilitate production cost reduction and achieving narrow border design.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the clams of the present invention.

What is claimed is:

1. A gate driver on array (GOA) circuit, which comprises: at least nine cascading GOA units including a first to a fourth GOA units, a last fourth to a last GOA units, and at least one in-between GOA unit, with each GOA unit comprising: a pull up control module, an output module, a pull down module and a pull down maintenance module;

for an N-th GOA unit of the at least nine cascading GOA unit, where N is a positive integer:

the pull up control module receiving a first control signal and a high voltage signal, connected to a first node, for pulling up voltage at the first node to the high voltage signal based on the cascade-propagate signal from (N−4)-th GOA unit; the output module receiving a clock signal and connected to the first node, for outputting a scan signal and a cascade-propagate signal under control by the voltage of the first node; the pull down module comprising a 41st TFT, the 41st TFT having a gate receiving a second control signal, a source connected to a predetermined signal, and a drain connected to the first node; the pull down maintenance module receiving the scan signal and a low voltage signal, connected to the first node, for maintaining the scan signal and the voltage of the first node at the low voltage signal after the pull down module pulling down the voltage of the first node;

wherein for the N-th GOA unit except the first to the fourth GOA units, the first control signal comprises a cascade propagate signal from an (N−4)-th GOA unit, and for each of the first to the fourth GOA units, the first control signal comprises a circuit start signal; and wherein for the N-th GOA unit except the last fourth to the last GOA units, the second control signal comprises a scan signal from an (N+4)-th GOA unit and the predetermined signal comprises the circuit start signal, and for each of the last fourth to the last GOA units, the second control signal comprises the circuit start signal and the predetermined signal comprises the low voltage signal;

the circuit start signal being a pulse signal, and the circuit start signal having a low voltage level lower than or equal to OV and higher than the low voltage signal.

2. The GOA circuit as claimed in claim 1, wherein the clock signal comprises: a first clock signal, a second clock signal, a third clock signal, a fourth clock signal, a fifth clock signal, a sixth clock signal, a seventh clock signal, and an eight clock signal, outputted serially; for a non-negative integer X, the (1+8X)-th GOA unit, the (2+8X)-th GOA unit, the (3+8X)-th GOA unit, the (4+8X)-th GOA unit, the (5+8X)-th GOA unit, the (6+8X)-th GOA unit, the (7+8X)-th GOA unit, and the (8+8X)-th GOA unit respectively receive the first clock signal, the second clock signal, the third clock signal, the fourth clock signal, the fifth clock signal, the sixth clock signal, the seventh clock signal, and the eight clock signal;

two adjacent clock signals have rising edges with a gap of ⅛ of cycle of the clock signal, the clock signal has a duty cycle ratio of 0.4;

the circuit start signal has a high voltage duration equal to ¾ of the cycle of the clocks signal;

the circuit start signal has a rising edge earlier than the rising edge of the first clock signal, with a gap of ¼ of the cycle of the clocks signal.

3. The GOA circuit as claimed in claim 1, wherein the low voltage level of circuit start signal and the low voltage signal have a voltage difference of 1.5-2.5V.

4. The GOA circuit as claimed in claim 3, wherein the low voltage level of circuit start signal is −4V and the low voltage signal is −6V.

5. The GOA circuit as claimed in claim 1, wherein except the first to the fourth GOA units, in the N-th GOA unit: the pull up control module comprises: a $11^{th}$ TFT; the $11^{th}$ TFT having a gate connected to the cascade-propagate signal from the (N−4)-th GOA unit, a source connected to the high voltage signal, and a drain connected to the first node.

6. The GOA circuit as claimed in claim 1, wherein the output module comprises: a $21^{st}$ TFT, a $22^{nd}$ TFT, and a capacitor; the $21^{st}$ TFT having a gate connected to the first node, a source connected to the clock signal, and a drain outputting the scan signal; the $22^{nd}$ TFT having a gate connected to the first node, a source connected to the clock signal, and a drain outputting the cascade-propagate signal; the capacitor having one end connected to the first node and the other end connected to the drain of the $21^{st}$ TFT.

7. The GOA circuit as claimed in claim 6, wherein the pull down maintenance module comprises: a $32^{nd}$ TFT, a $42^{nd}$ TFT, a $51^{st}$ TFT, and a $52^{nd}$ TFT; the $32^{nd}$ TFT having a gate connected to a second node, a source connected to the low voltage signal, and a drain connected to the drain of the $21^{st}$ TFT; the $42^{nd}$ TFT having a gate connected to the second node, a source connected to the low voltage signal, and a drain connected to the first node; the $51^{st}$ TFT having a gate and a source connected to a control signal, and a drain connected to the second node; $52^{nd}$ TFT having a gate connected to the first node, a source connected to the low voltage signal, and a drain connected to the second node.

8. The GOA circuit as claimed in claim 7, wherein the control signal maintains at high voltage during the GOA unit operates.

9. The GOA circuit as claimed in claim 1, wherein in the first to the fourth GOA units, the pull up control module comprises: an $11^{th}$ TFT, the $11^{th}$ TFT having a gate connected to the circuit start signal, a source connected to the high voltage signal, and a drain connected to the first node.

10. The GOA circuit as claimed in claim 1, wherein in the last fourth to the last GOA units, the pull down module comprises: a $41^{st}$ TFT, the $41^{st}$ TFT having a gate connected to the circuit start signal, a source connected to the low voltage signal, and a drain connected to the first node.

11. A gate driver on array (GOA) circuit, which comprises: at least nine cascading GOA units including a first to a fourth GOA units, a last fourth to a last GOA units, and at least one in-between GOA unit, with each GOA unit comprising: a pull up control module, an output module, a pull down module and a pull down maintenance module;

for an N-th GOA unit of the at least nine cascading GOA unit, where N is a positive integer:

the pull up control module receiving first control signal and a high voltage signal, connected to a first node, for pulling up voltage at the first node to the high voltage signal based on the cascade-propagate signal from (N−4)-th GOA unit; the output module receiving a clock signal and connected to the first node, for outputting a scan signal and a cascade-propagate signal under control by the voltage of the first node; the pull down module comprising a 41st TFT, the 41st TFT having a gate receiving a second control signal, a source connected to a predetermined signal, and a drain connected to the first node; the pull down maintenance module receiving the scan signal and a low voltage signal, connected to the first node, for maintaining the scan signal and the voltage of the first node at the low voltage signal after the pull down module pulling down the voltage of the first node;

wherein for the N-th GOA unit except the first to the fourth GOA units, the first control signal comprises a cascade propagate signal from an (N−4)-th GOA unit, and for each of the first to the fourth GOA units, the first control signal comprises a circuit start signal; and wherein for the N-th GOA unit except the last fourth to the last GOA units, the second control signal comprises a scan signal from an (N+4)-th GOA unit and the predetermined signal comprises the circuit start signal, and for each of the last fourth to the last GOA units, the second control signal comprises the circuit start signal and the predetermined signal comprises the low voltage signal;

the circuit start signal being a pulse signal, and the circuit start signal having a low voltage level lower than or equal to OV and higher than the low voltage signal;

wherein the clock signal comprising: a first clock signal, a second clock signal, a third clock signal, a fourth clock signal, a fifth clock signal, a sixth clock signal, a seventh clock signal, and an eight clock signal, outputted serially; for a non-negative integer X, the (I+8X)-th GOA unit, the (2+8X)-th GOA unit, the (3+8X)-th GOA unit, the (4+8X)-th GOA unit, the (5+8X)-th GOA unit, the (6+8X)-th GOA unit, the (7+8X)-th GOA unit, and the (8+8X)-th GOA unit respectively receiving the first clock signal, the second clock signal, the third clock signal, the fourth clock signal, the fifth clock signal, the sixth clock signal, the seventh clock signal, and the eight clock signal; two adjacent clock signals having rising edges with a gap of ⅛ of cycle of the clock signal, the clock signal having a duty cycle ratio of 0.4;

the circuit start signal having a high voltage duration equal to ¾ of the cycle of the clocks signal;

the circuit start signal having a rising edge earlier than the rising edge of the first clock signal, with a gap of ¼ of the cycle of the clocks signal;

wherein except the first to the fourth GOA units, in the N-th GOA unit: the pull up control module comprises: a 11th TFT; the 11th TFT having a gate connected to the cascade-propagate signal from the (N−4)-th GOA unit, a source connected to the high voltage signal, and a drain connected to the first node;

wherein the output module comprises: a 21st TFT, a 22nd TFT, and a capacitor; the 21st TFT having a gate connected to the first node, a source connected to the clock signal, and a drain outputting the scan signal; the 22nd TFT having a gate connected to the first node, a source connected to the clock signal, and a drain outputting the cascade-propagate signal; the capacitor having one end connected to the first node and the other end connected to the drain of the 21st TFT;

wherein the pull down maintenance module comprises: a 32nd TFT, a 42nd TFT, a 51st TFT, and a 52nd TFT; the 32nd TFT having a gate connected to a second node, a source connected to the low voltage signal, and a drain connected to the drain of the 21st TFT; the 42nd TFT having a gate connected to the second node, a source connected to the low voltage signal, and a drain connected to the first node; the 51st TFT having a gate and a source connected to a control signal, and a drain connected to the second node; 52nd TFT having a gate connected to the first node, a source connected to the low voltage signal, and a drain connected to the second node;

wherein the control signal maintains at high voltage during the GOA unit operating.

12. The GOA circuit as claimed in claim 11, wherein the low voltage level of circuit start signal and the low voltage signal have a voltage difference of 1.5-2.5V.

13. The GOA circuit as claimed in claim 12, wherein the low voltage level of circuit start signal is −4V and the low voltage signal is −6V.

14. The GOA circuit as claimed in claim 11, wherein in the first to the fourth GOA units, the pull up control module comprises: an $11^{th}$ TFT, the $11^{th}$ TFT having a gate connected to the circuit start signal, a source connected to the high voltage signal, and a drain connected to the first node.

15. The GOA circuit as claimed in claim 11, wherein in the last fourth to the last GOA units, the pull down module comprises: a $41^{st}$ TFT, the $41^{st}$ TFT having a gate connected to the circuit start signal, a source connected to the low voltage signal, and a drain connected to the first node.

* * * * *